US012290744B1

(12) United States Patent
Jones et al.

(10) Patent No.: US 12,290,744 B1
(45) Date of Patent: May 6, 2025

(54) CUE STICK HOLDERS AND METHODS OF FABRICATION AND USE THEREOF

(71) Applicants: Danny J. Jones, Natchitoches, LA (US); Tamara L. Jones, Natchitoches, LA (US)

(72) Inventors: Danny J. Jones, Natchitoches, LA (US); Tamara L. Jones, Natchitoches, LA (US)

( * ) Notice: Subject to any disclaimer, the term of this patent is extended or adjusted under 35 U.S.C. 154(b) by 0 days.

(21) Appl. No.: 18/224,857

(22) Filed: Jul. 21, 2023

(51) Int. Cl.

| | |
|---|---|
| ***A63D 15/10*** | (2006.01) |
| ***A47B 81/00*** | (2006.01) |
| ***A47F 7/00*** | (2006.01) |
| *A47F 5/10* | (2006.01) |

(52) U.S. Cl.
CPC ..... *A63D 15/10* (2013.01); *A47B 81/005* (2013.01); *A47F 7/0028* (2013.01); *A47F 5/10* (2013.01); *A47F 7/0021* (2013.01)

(58) Field of Classification Search
CPC ..... A63D 15/10; A63D 15/105; A47F 7/00; A47F 7/0021; A47F 7/0028; A47F 7/0035; A47F 2001/103; A47F 2005/0012; A47F 5/10; A47B 81/005; A47B 81/007; A47B 81/00; A47B 81/04
USPC ..... 211/68, 85.4, 70.7, 85.7, 60.1
See application file for complete search history.

(56) References Cited

U.S. PATENT DOCUMENTS

| | | | | | |
|---|---|---|---|---|---|
| 239,931 | A * | 4/1881 | Bullock | A63D 15/105 | 473/42 |
| 337,888 | A * | 3/1886 | Swan | B25H 3/003 | 206/379 |
| 968,187 | A * | 8/1910 | McIntire | A63D 15/105 | 473/42 |
| 1,240,705 | A * | 9/1917 | Grode | A63D 15/10 | 211/68 |
| 1,683,533 | A * | 9/1928 | Drost | A63D 15/10 | 211/68 |
| 1,719,360 | A * | 7/1929 | Deike | A63B 55/10 | 211/70.2 |
| 1,969,958 | A * | 8/1934 | Alder | A47K 3/003 | 4/577.1 |
| D105,428 | S * | 7/1937 | Bahr | D6/583 | |
| 2,613,079 | A * | 10/1952 | Reynolds | A63D 15/12 | 211/68 |
| 2,664,005 | A * | 12/1953 | Kosinski | A47J 47/16 | 248/37.3 |
| 2,807,361 | A * | 9/1957 | Junkin | B65D 5/504 | 206/564 |
| 2,817,525 | A * | 12/1957 | Niemann | A63D 15/10 | 473/42 |
| 2,903,129 | A * | 9/1959 | Anderson, III | A61B 50/33 | 206/363 |
| 2,903,139 | A * | 9/1959 | Penman | G09F 5/042 | 211/70.1 |

(Continued)

*Primary Examiner* — Devin K Barnett
(74) *Attorney, Agent, or Firm* — R. Keith Harrison

(57) ABSTRACT

Cue stick holders suitable for deployment on a pool, billiards, or like game table to support at least one cue stick as the cue stick rests in a propped position against the game table typically between plays of a game or between games may include a flexible holder panel configured for frictional immobilization on the game table. A holder rack may be provided on the holder panel. The holder rack may have at least one cue stick gap sized and configured to receive the at least one cue stick in the propped position thereof.

18 Claims, 16 Drawing Sheets

(56) References Cited

U.S. PATENT DOCUMENTS 3,146,889 A * 9/1964 Franco ..... A63D 15/10 211/68
D200,815 S * 4/1965 Chard ..... D3/313
3,212,907 A * 10/1965 Caprioli ..... B65D 1/36 426/115
3,581,929 A * 6/1971 Guenard ..... B65D 81/022 220/555
3,590,752 A * 7/1971 De Pew ..... B65D 19/44 108/53.5
4,053,153 A * 10/1977 Josenhans ..... A63D 15/105 473/43
D246,491 S * 11/1977 D'Alo ..... D6/682.4
4,084,778 A * 4/1978 Dominguez ..... G10G 5/00 248/314
4,120,495 A * 10/1978 Moughler ..... A63D 15/105 473/43
4,182,455 A * 1/1980 Zurawin ..... B65D 71/70 211/69.8
4,229,420 A * 10/1980 Smith ..... A61B 50/22 606/1
4,342,390 A * 8/1982 Mitchell ..... A61B 50/30 206/363
D273,761 S * 5/1984 Takei ..... D8/354
D278,749 S * 5/1985 Martinovics ..... D27/134
D279,721 S * 7/1985 Martinovics ..... D27/134
D293,469 S * 12/1987 Greenblatt ..... D24/229
4,746,010 A * 5/1988 Fournier ..... B65D 81/36 206/746
4,807,381 A * 2/1989 Southard ..... A47B 81/005 211/64
4,834,328 A * 5/1989 Hall ..... A47G 21/14 248/37.3
4,901,870 A * 2/1990 Wright ..... B65D 85/20 211/59.4
D310,302 S * 9/1990 Southard ..... 211/163
4,967,914 A * 11/1990 Keeton ..... A47G 21/14 211/70.7
5,072,908 A * 12/1991 Lodrick ..... A63D 15/10 248/231.51
5,097,963 A * 3/1992 Chernosky ..... A61B 50/20 D24/227
5,123,547 A * 6/1992 Koch ..... F16L 3/2235 248/68.1
5,165,681 A * 11/1992 Enger ..... A63D 15/105 473/36
D334,867 S * 4/1993 May ..... D7/504
D338,795 S * 8/1993 Huang ..... D6/552
5,255,799 A 10/1993 Haynes
5,267,652 A * 12/1993 Carroll ..... B26D 7/01 410/32
5,370,288 A * 12/1994 Field ..... A45C 13/02 224/256
5,433,322 A * 7/1995 Williams ..... A47B 87/0207 206/509
5,875,943 A * 3/1999 Frandsen, Sr. ..... B60R 5/00 224/571
5,924,662 A * 7/1999 Monty ..... A63D 15/16 248/205.2
5,961,927 A * 10/1999 Isaacs ..... B01L 9/54 211/60.1
6,092,675 A * 7/2000 Ramirez, Jr. ..... A63D 15/10 473/44
D438,634 S * 3/2001 Merry ..... D24/227
D441,193 S * 5/2001 Edwards ..... D3/316
D446,424 S * 8/2001 Hall ..... A47F 7/0035 D7/637
6,318,567 B1 * 11/2001 Braley ..... A47B 49/004 248/37.3
6,591,984 B2 * 7/2003 Odierno ..... A61M 5/008 206/365
D485,319 S * 1/2004 Keller ..... D21/782
D499,607 S * 12/2004 Lyon ..... D7/504
6,945,413 B1 9/2005 Meyer
6,994,304 B2 * 2/2006 Kim ..... A47G 21/14 248/37.3
7,080,864 B2 * 7/2006 Casteran ..... B66C 1/16 294/67.4
7,137,602 B2 * 11/2006 Carpenter ..... A63B 55/50 211/85.7
D534,610 S * 1/2007 Weinstein ..... D21/782
D619,405 S * 7/2010 Vainshtein ..... D6/613
7,815,057 B2 * 10/2010 Bush ..... A63D 15/10 211/14
7,975,857 B2 * 7/2011 Restis ..... A47J 47/16 206/553
8,162,156 B1 * 4/2012 Crisman ..... G10D 13/12 211/85.6
D662,320 S * 6/2012 De Leo ..... D3/274
D669,937 S * 10/2012 Lira-Nunez ..... D19/77
D677,426 S * 3/2013 Henry ..... D27/136
8,505,748 B2 * 8/2013 Jones ..... A61B 50/20 206/370
D695,546 S * 12/2013 Kruger ..... D6/534
8,668,171 B2 * 3/2014 Tarantino ..... A47G 21/14 248/37.3
8,727,142 B2 * 5/2014 Shapiro ..... A47B 97/00 248/37.3
D728,349 S * 5/2015 Lake ..... D8/356
D740,619 S * 10/2015 Elliott ..... D7/637
9,539,492 B1 * 1/2017 Eager ..... A63D 15/006
D790,127 S * 6/2017 Verleur ..... D6/552
D812,476 S * 3/2018 Bergeron ..... D9/756
D817,723 S * 5/2018 Elattrache ..... D7/638
D821,120 S * 6/2018 Chang ..... D6/675.4
10,398,243 B2 * 9/2019 Sedgwick ..... A47G 19/30
10,542,738 B2 * 1/2020 Moses ..... A47F 7/0035
10,555,630 B2 * 2/2020 Green ..... A47G 21/14
D886,549 S * 6/2020 Kim ..... D7/637
D904,069 S * 12/2020 Juilly ..... D6/534
D904,832 S * 12/2020 Medeiros Santos ..... D7/637
D943,765 S * 2/2022 Griffin ..... D24/231
11,357,591 B2 * 6/2022 Brown ..... A61L 2/26
D970,981 S * 11/2022 Zhang ..... D7/637
D972,068 S * 12/2022 Ray ..... D6/552
D986,692 S * 5/2023 Elattrache ..... D7/637
D1,015,082 S * 2/2024 Ciarrocchi ..... D7/637
2002/0074299 A1 * 6/2002 Zummo ..... A63D 15/10 211/68
2002/0111220 A1 * 8/2002 Trimino, Jr. ..... A63D 15/10 473/42
2003/0057170 A1 * 3/2003 Awalt ..... A47F 7/0071 211/85.4
2003/0150825 A1 * 8/2003 Dickerson ..... A47G 19/30 211/85.4
2003/0211897 A1 * 11/2003 Morton ..... A63D 15/105 473/42
2005/0023234 A1 * 2/2005 Head ..... A47G 19/30 211/85.4
2005/0061696 A1 * 3/2005 Swank ..... A61B 50/20 206/363
2005/0194335 A1 * 9/2005 Hibner ..... A63B 71/0045 211/85.7
2006/0009300 A1 * 1/2006 Hernandez ..... A63D 15/105 473/42
2006/0025228 A1 * 2/2006 Light ..... A63D 15/105 473/42
2006/0076254 A1 * 4/2006 Corbitt, Jr. ..... A61B 50/22 206/370
2007/0102380 A1 * 5/2007 Shaw ..... A47F 7/0035 211/85.7
2007/0125731 A1 * 6/2007 Waterman ..... A63C 11/028 211/85.7
2007/0193964 A1 * 8/2007 Helms ..... A63D 15/10 211/68
2008/0041757 A1 * 2/2008 Nelson ..... A47J 47/005 248/37.3
2008/0125233 A1 * 5/2008 Tucker ..... A63D 15/006 473/2

(56) References Cited

U.S. PATENT DOCUMENTS

2008/0283478 A1* 11/2008 Amirault ..... A47K 10/04 211/13.1
2008/0286431 A1* 11/2008 Brown ..... A47G 19/30 426/560
2009/0065456 A1* 3/2009 Gold ..... A47G 19/02 211/85.4
2009/0186714 A1* 7/2009 Van Buren ..... A63D 15/10 473/42
2009/0186715 A1* 7/2009 Bush ..... A63D 15/10 473/42
2009/0261049 A1* 10/2009 McQuary ..... A47F 7/0028 211/70.7
2009/0294387 A1* 12/2009 Spencer ..... A63D 15/10 473/1
2010/0181268 A1* 7/2010 Benson ..... H02G 3/0487 211/60.1
2010/0183814 A1* 7/2010 Rios ..... A63B 60/00 427/387
2011/0147542 A1* 6/2011 Hoek ..... H02G 3/32 248/68.1
2012/0211454 A1* 8/2012 Wilson ..... A47G 23/06 211/133.6
2013/0055621 A1* 3/2013 Fong ..... A01K 97/10 43/21.2
2015/0083680 A1* 3/2015 Beckerich ..... A63D 15/10 211/85.7
2016/0206176 A1* 7/2016 Eilmus ..... A47J 47/20
2017/0360525 A1* 12/2017 Brown ..... B65B 7/00
2018/0104568 A1* 4/2018 Klimeck ..... A63D 15/105
2018/0304144 A1* 10/2018 Manou ..... A63D 15/105
2019/0388773 A1* 12/2019 Hills ..... A63D 15/105
2022/0258034 A1* 8/2022 Webb ..... A63D 15/105
2023/0088877 A1* 3/2023 Perez ..... A47J 45/02 211/70.7
2023/0276969 A1* 9/2023 Chapman ..... A47G 19/30 211/85.4

* cited by examiner

CUE STICK HOLDERS AND METHODS OF FABRICATION AND USE THEREOF

FIELD

Illustrative embodiments of the disclosure generally relate to the game of pool or billiards. More particularly, illustrative embodiments of the disclosure relate to cue stick holders suitable for securely holding one or more cue sticks in a propped position against a pool, billiards, or like game table between uses of the cue stick.

SUMMARY

Illustrative embodiments of the disclosure are generally directed to cue stick holders suitable for deployment on a pool, billiards, or like game table to support at least one cue stick as the cue stick rests in a propped position against the game table typically between plays of a game or between games. An illustrative embodiment of the cue stick holders may include a flexible holder panel configured for frictional immobilization on the game table. A holder rack may be provided on the holder panel. The holder rack may have at least one cue stick gap sized and configured to receive the at least one cue stick in the propped position thereof.

In one aspect, the holder panel may include a front panel end and a rear panel end. The holder rack may be proximate to the front panel end.

In another aspect, the holder panel may have a uniform material, thickness, and density from the front panel end to the rear panel end.

In another aspect, the holder panel may be selectively deployable in an extended functional configuration and a rolled storage configuration.

In another aspect, at least one securing member may be configured to secure the holder panel in the rolled storage configuration.

In another aspect, the holder panel may include silicone.

In another aspect, a plurality of panel protrusions may protrude from the holder panel. The panel protrusions may enhance frictional immobilization of the holder panel on the game table.

In another aspect, the holder rack may include a holder rack base portion and a pair of holder rack side portions. Each cue stick gap may extend into the holder rack base portion between the holder rack side portions.

In some embodiments, the cue stick holder may include a flexible holder panel having a bottom panel surface, a top panel surface, and a panel midline. A rack support portion may extend forwardly of the panel midline. An anchor portion may extend rearwardly of the panel midline. The bottom panel surface of the holder panel at the anchor portion may be configured for frictional immobilization on the game table. A flexible holder rack may be provided on the top panel surface of the holder panel at the rack support portion. The holder rack may have at least one cue stick gap sized and configured to receive the cue stick in the propped position thereof.

In some embodiments, the cue stick holders may be suitable for deployment on a pool, billiards, or like game table having table sides, a table top and a table edge to support at least one cue stick as the cue stick rests in a propped position against the game table. The cue stick holders may include a flexible holder panel. The holder panel may include a bottom panel surface, a top panel surface, a front panel end, a rear panel end, and a panel midline halfway between the front panel end and the rear panel end. A rack support portion may extend forwardly of the panel midline. An anchor portion may extend rearwardly of the panel midline. The bottom panel surface of the holder panel at the anchor portion may be configured for frictional immobilization on the table top of the game table. A flexible holder rack may be provided on the top panel surface of the holder panel at the rack support portion. The holder rack and the holder panel may be formed in one piece of like material and may have a unitary construction. The holder rack may include at least two rack side walls extending from the top panel surface of the holder panel in spaced-apart relationship to each other. At least one cue stick gap may be provided between the rack side walls, respectively. Each cue stick gap may be sized and configured to receive the corresponding cue stick in the propped position thereof. The holder panel and the holder rack may be selectively deployable in an extended configuration and rolled storage configuration.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
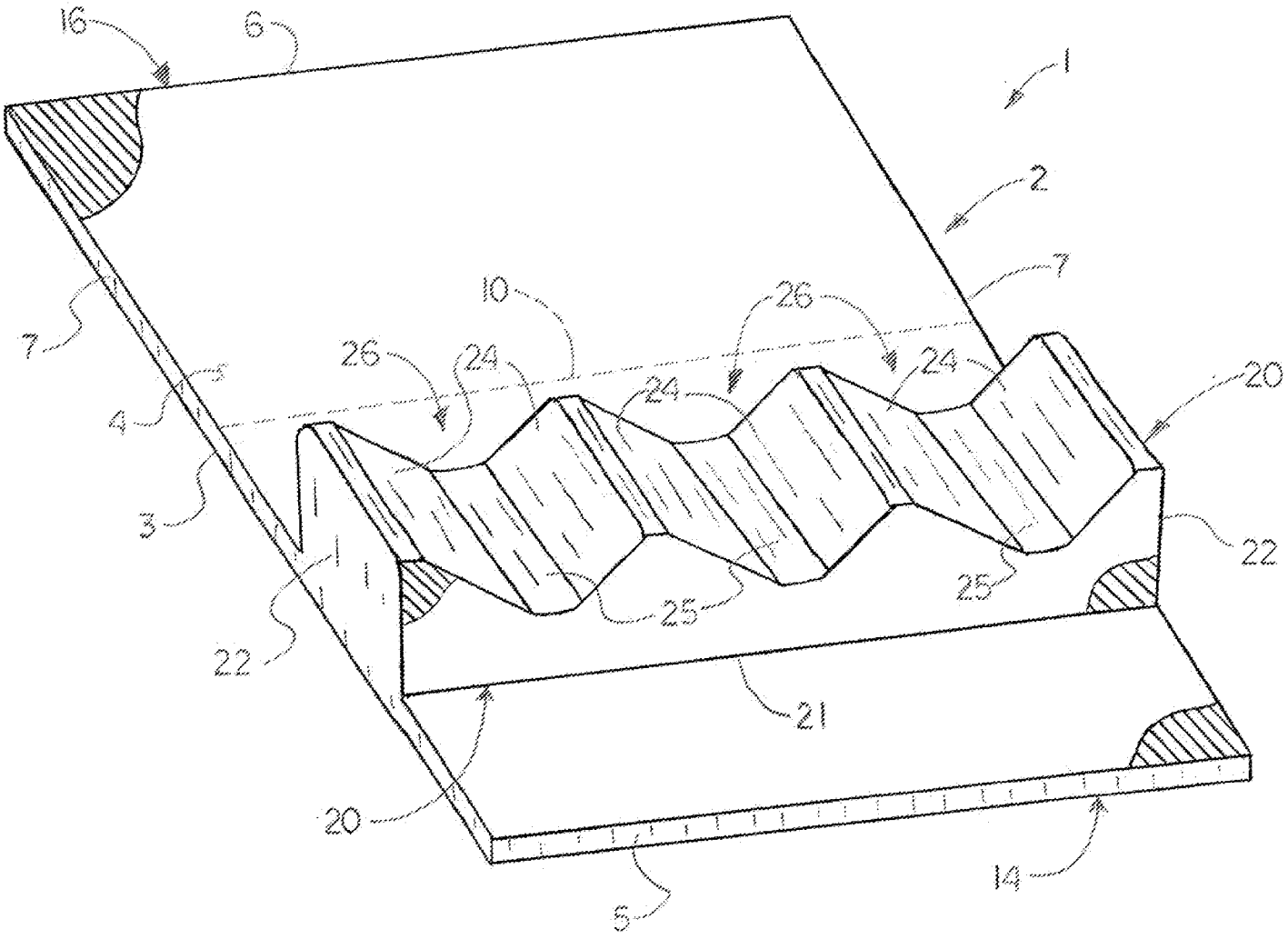
FIG. 1 is a front perspective view of an illustrative embodiment of the cue stick holders of the disclosure, with the illustrative cue stick holder deployed in an extended configuration preparatory to use.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "aft", "right", "fore", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Unless expressly or implicitly indicated otherwise, throughout the description and the appended claims, the terms "comprise", "comprising", "comprised of", "having", "including", and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition term "comprise" or "comprises" means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment.

Unless otherwise noted using precise or limiting terminology, all numbers which express quantities of ingredients throughout the specification and claims are to be understood as being approximations of the numerical value cited to express the quantities of those ingredients. As used throughout the specification and claims, the terms "about" and "generally" have the meaning reasonably ascribed to those terms by a person skilled in the art when used in conjunction with a stated numerical value or range, i.e., denoting from the exact stated value or range to somewhat more or somewhat less than the stated value or range, from a deviation of from 0% with respect to the stated value or range to up to and including 15% of the stated value or range in either direction.

Figure 7:
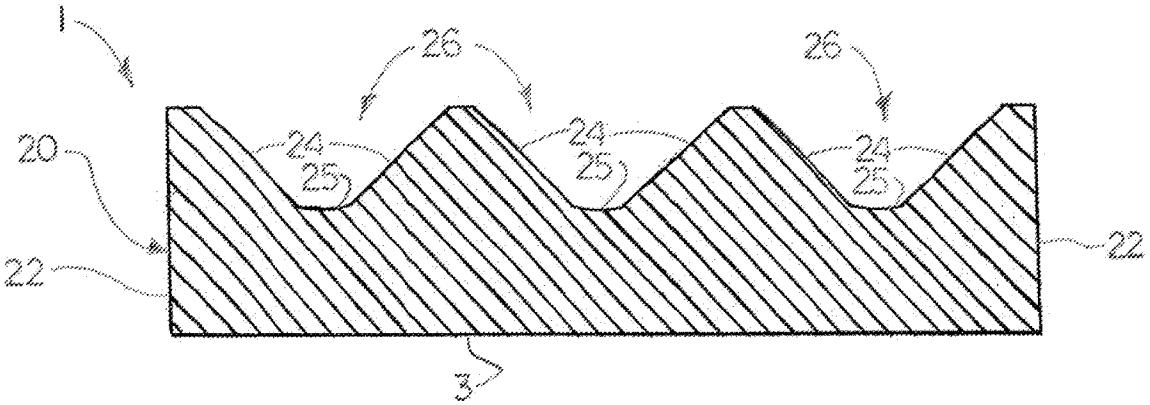
FIG. 7 is a cross-sectional view, taken along section lines 7-7 in FIG. 4, of the holder rack of the illustrative cue stick holder.
Figure 8:
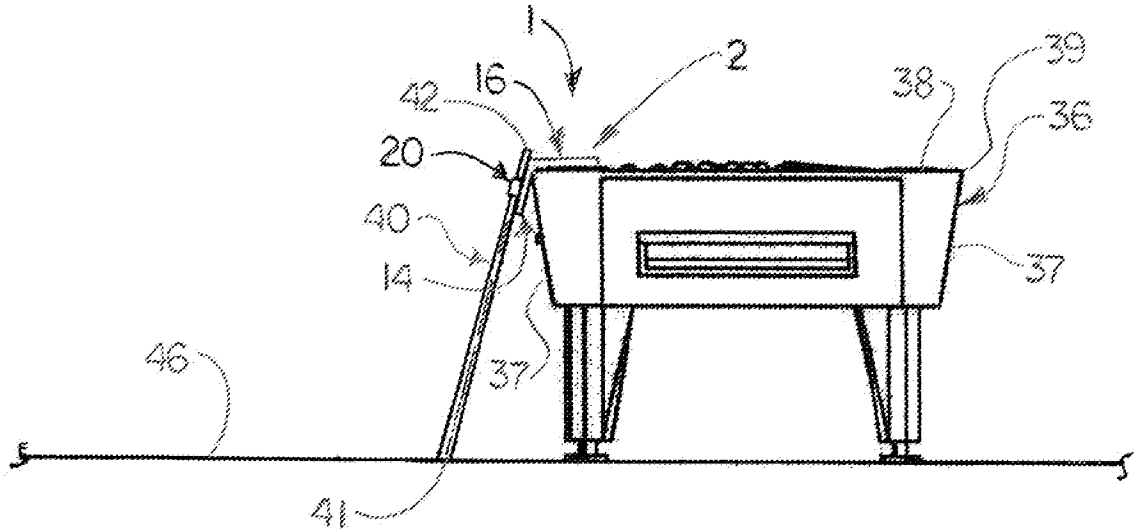
FIG. 8 is an end view of a game table, with the illustrative cue stick holder deployed on the game table and a cue stick propped against the cue stick holder in typical application of the cue stick holder.
Figure 9:
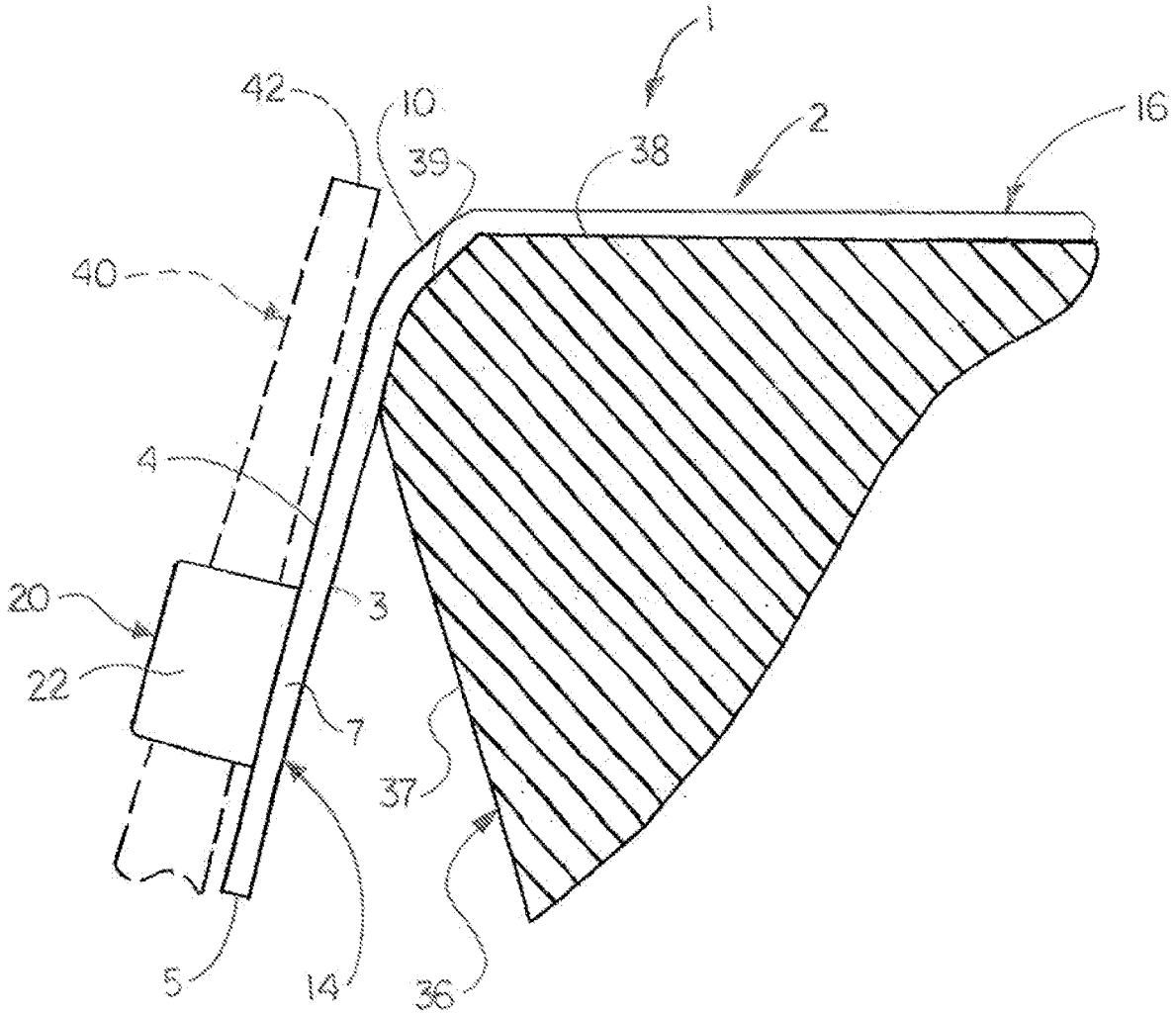
FIG. 9 is an enlarged sectional view of a table edge of the game table illustrated in FIG. 8, with the anchor portion of the holder panel of the cue stick holder (shown partially in section) resting on the table top of the game table, the rack support portion of the holder panel suspended over the table edge adjacent to a side of the table, and the cue stick (illustrated in phantom) resting in the holder rack on the rack support portion of the holder panel.
Figure 11:
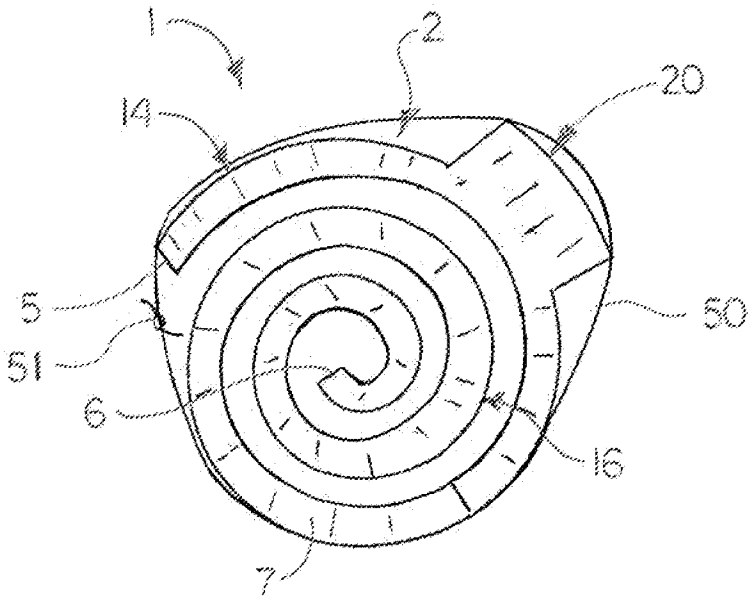
FIG. 11 is a side view of the illustrative cue stick holder, deployed in a rolled storage configuration with a securing member securing the cue stick holder in the storage configuration.
Figure 10:
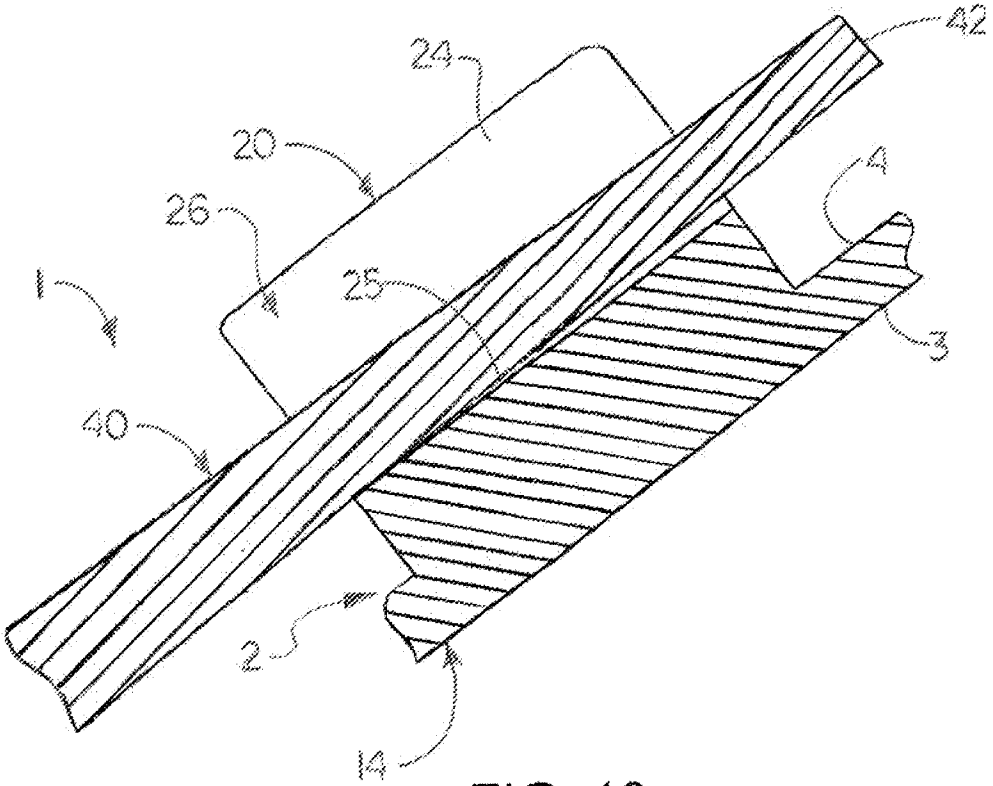
FIG. 10 is a sectional view of the holder rack on the rack support portion of the holder panel of the illustrative cue stick holder with the cue stick (illustrated in longitudinal section) resting in a cue stick gap of the holder rack.

Referring initially to FIGS. 1-11 of the drawings, an illustrative embodiment of the cue stick holder is generally indicated by reference number 1. As illustrated in FIGS. 8-10 and will be hereinafter described, in typical application, the cue stick holder 1 may be suitable for securely holding at least one cue stick 40 in a propped position against a pool, billiards, or like game table 36 typically between uses of the cue stick 40 during a game and/or between games. The cue stick holder 1 may thus securely support the cue stick 40 in the propped position between uses for subsequent ease of access as well as protect the game table 36 from being scratched by the cue stick 40, and vice-versa. As illustrated in FIG. 11, in some embodiments, the cue stick holder 1 may be configured to be deployed in a rolled storage configuration for ease of stowage and transport in a carrying bag (not illustrated), for example.

The cue stick holder 1 may include a flexible holder panel 2. The holder panel 2 may be configured for frictional immobilization on the game table 36 (FIGS. 8 and 9). A holder rack 20 may be provided on the holder panel 2. The holder rack 20 may have at least one cue stick gap 26. Each cue stick gap 26 may be suitably sized and configured to receive at least one cue stick 40 in the propped position of the cue stick 40, as illustrated in FIG. 10.

In some embodiments, the holder panel 2 may include a front panel end 5 and a rear panel end 6. The holder rack 20 may be proximate, or closer to, the front panel end 5 than to the rear panel end 6 of the holder panel 2. In some embodiments, the holder panel 2 may be square or rectangular in shape, as illustrated. Accordingly, the holder panel 2 may have a pair of parallel side panel edges 7 which extend between the front panel end or edge 5 and the rear panel end or edge 6. In other embodiments, the holder panel 2 may be circular, elliptical, or oval, or may have a triangular, pentagonal, hexagonal, or other polygonal shape. In some embodiments, the holder panel 2 of the cue stick holder 1 may have a uniform material, thickness, and density from the front panel end 5 to the rear panel end 6.

As will be hereinafter described, in some embodiments, the holder panel 2 of the cue stick holder 1 may be selectively deployable in an extended functional configuration (FIG. 1) and a rolled storage configuration (FIG. 11). As further illustrated in FIG. 11, at least one securing member 50 may be configured to secure the holder panel 2 in the rolled storage configuration. The securing member 50 may include at least one string, strap, cable, wire, chain, cord, and/or other elongated member which is suitable to wrap or extend around the rolled holder panel 2. At least one closure element 51 may facilitate selective securement of the securing member 50. The closure element 51 may include a knot, buckle, clamp, hook and loop fasteners, and/or any other device, mechanism, or combination thereof suitable for the purpose of securing the securing member 50.

In some embodiments, the holder panel 2 of the cue stick holder 1 may include any material or combination of materials which may facilitate selective deployment of the holder panel 2 in the extended configuration illustrated in FIG. 1 and the rolled storage configuration illustrated in FIG. 11. For example and without limitation, in some embodiments, the holder panel 2 may include silicone. In some embodiments, the holder panel 2 may additionally or alternatively include rubber and/or plastic material or materials which may render the holder panel 2 sufficiently flexible to facilitate deployment of the holder panel 2 in the extended and storage configurations.

Figure 3:
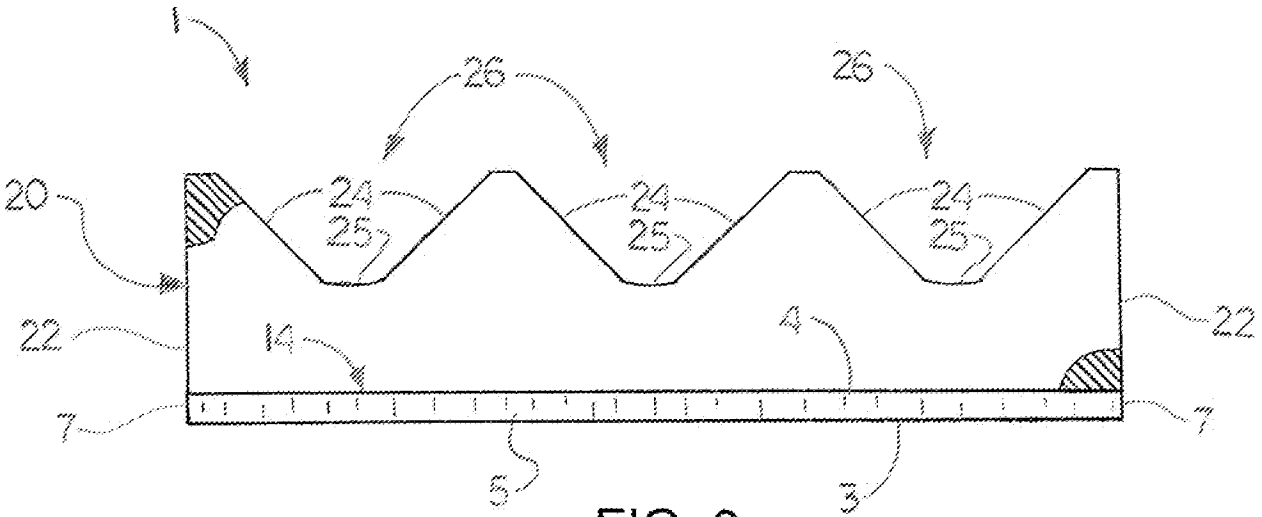
FIG. 3 is a front view of the illustrative cue stick holder.

As particularly illustrated in FIGS. 1 and 3, in some embodiments, the holder rack 20 of the cue stick holder 1 may include a holder rack base portion 20. The holder rack base portion 20 may have a pair of holder rack side portions 22. Each cue stick gap 26 may extend into the holder rack base portion 21 between the holder rack side portions 22.

Each cue stick gap 26 in the holder rack 20 may have a gap bottom surface 25. A pair of gap walls 24 may angle or slope from the gap bottom surface 25. Each cue stick gap 26 may be formed by and between each gap bottom surface 25 and the corresponding pair of gap walls 24. In some embodiments, the gap walls 24 of each cue stick gap 26 may each be straight or planar, as illustrated. In other embodiments, each gap wall 24 may be concave, or convex. Likewise, the gap bottom surface 25 of each cue stick gap 26 may be planar, concave, or convex.

Figure 2:
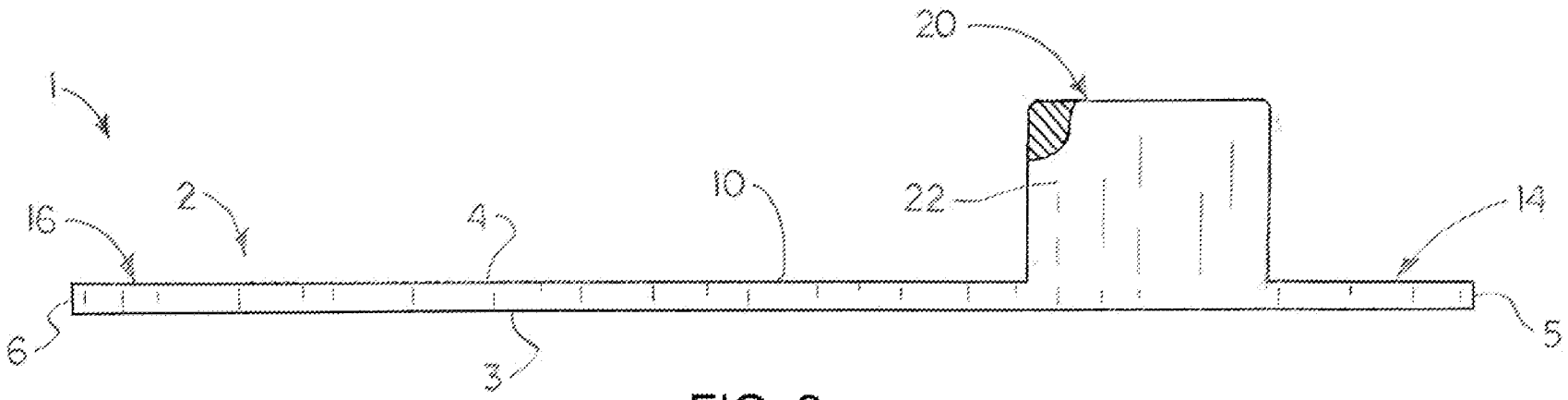
FIG. 2 is a right-side view of the illustrative cue stick holder illustrated in FIG. 1.
Figure 4:
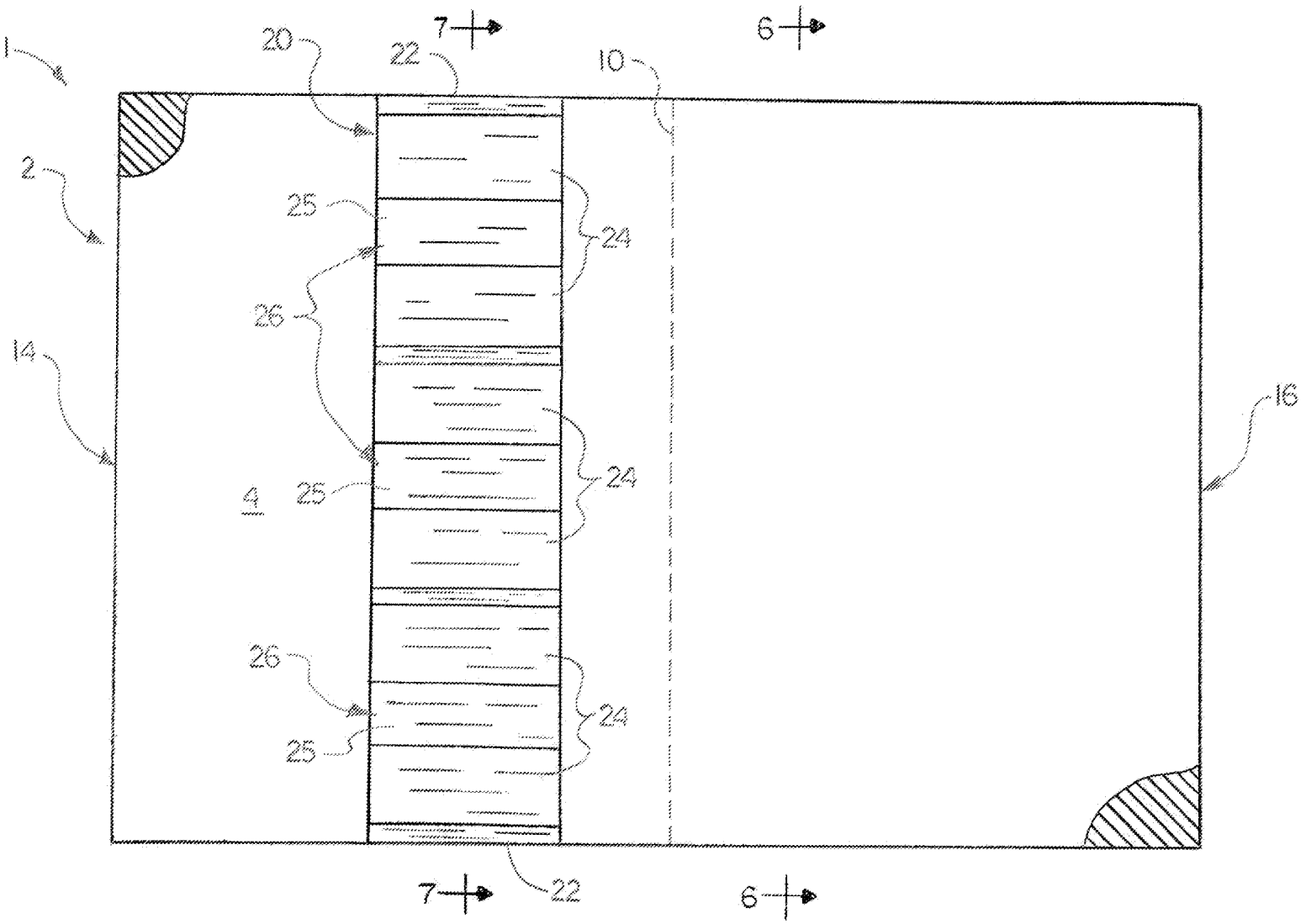
FIG. 4 is a top view of the illustrative cue stick holder.
Figure 5:
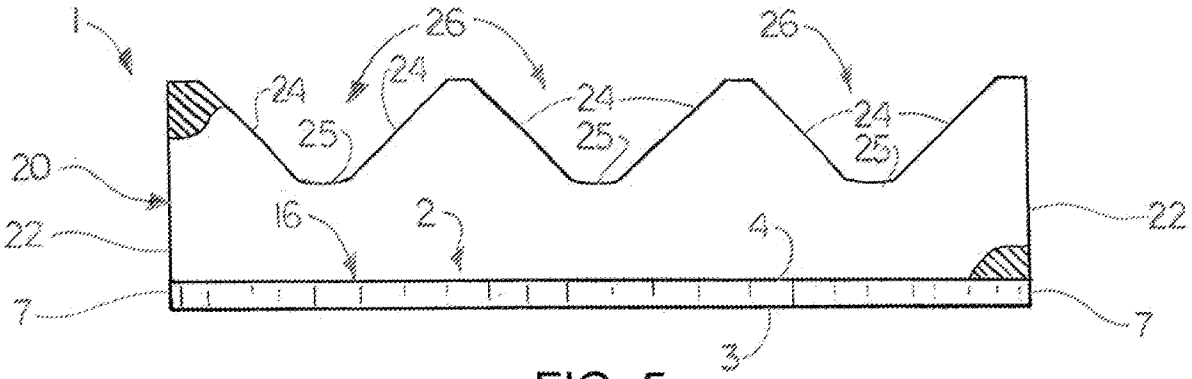
FIG. 5 is a rear view of the illustrative cue stick holder.
Figure 6:
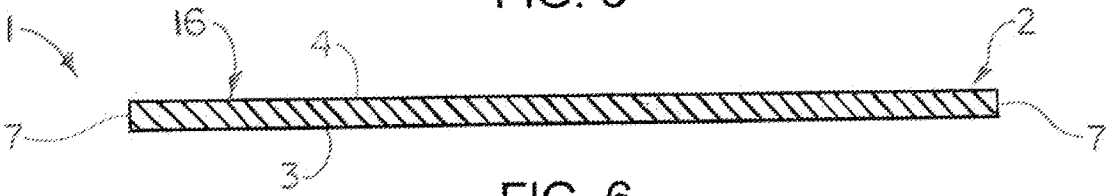
FIG. 6 is a cross-sectional view, taken along section lines 6-6 in FIG. 4, of the holder panel of the illustrative cue stick holder.

As illustrated in FIGS. 2 and 3, in some embodiments, the holder panel 2 of the cue stick holder 1 may have a bottom panel surface 3 and a top panel surface 4. Each of the bottom panel surface 3 and the top panel surface 4 of the cue stick holder 1 may be flat or planar. The holder rack 20 may extend from the top panel surface 4 of the holder panel 2. As illustrated in FIGS. 1 and 4, the holder panel 2 may have an imaginary panel midline 10. The panel midline 10 may divide the holder panel 2 into equal halves. A rack support portion 14 of the holder panel 2 may extend forwardly of the panel midline 10. An anchor portion 16 of the holder panel 2 may extend rearwardly of the panel midline 10. The bottom panel surface 3 of the holder panel 2 at the anchor portion 16 may be configured to frictionally engage the game table 36 for frictional immobilization of the cue stick holder 1 on the game table 36, typically as will be hereinafter described.

In some embodiments, the holder rack 20 of the cue stick holder 1 may be flexible. As illustrated in FIG. 7, in some embodiments, the holder rack 20 and the holder panel 2 may be formed in one piece and of like material and may have a unitary construction. Accordingly, the holder panel 2 and the holder rack 20 may be homogenous throughout in material and density.

As illustrated in FIGS. 8-11, in typical application, the cue stick holder 1 may be deployed on the pool, billiards, or like game table 36 to securely hold one or more cue sticks 40 in the propped position against the game table 36 typically between uses of the cue stick 40 in a pool, billiards, or like game which may be carried out on the game table 36, or between games. In some applications, the game table 36 may be a standard or conventional pool or billiards table with table sides 37, a table top 38, and a table edge 39 between the table sides 37 and the table top 38. The cue stick 40 may be a standard or conventional cue stick used in pool or billiards, with a rear cue stick end 41 and a cue stick tip 42.

The cue stick holder 1 may be deployed in place on the game table 36 by placement of the bottom panel surface 3 of the anchor portion 16 of the holder panel 2 on the table top 38 of the game table 36. Due to the relatively high coefficient of friction of the bottom panel surface 3, the anchor portion 16 of the holder panel 2 may remain securely in place and immobilized on the table top 38 solely by frictional engagement of the anchor portion 16 with the table top 38. As illustrated in FIG. 9, the portion of the holder panel 2 which corresponds to the panel midline 10 may traverse or correspond in position to the table edge 39 of the game table 36, whereas the rack support 14 of the holder panel 2 may extend or be suspended vertically or at an angle adjacent to the corresponding table side 37 of the game table 36. The top panel surface 4 of the rack support portion 14 may face outwardly away from the table side 37 such that the holder rack 20 is exposed on the top panel surface 4.

In some embodiments, the cue stick holder 1 may have a unitary construction and may consist essentially of a holder panel 2 having a uniform material, thickness, and density from the front panel end 5 to the rear panel end 6 and a holder rack 20 formed or molded in one piece with the holder panel 2. The cue stick holder 1 may be molded from a liquid holder material comprising silicone, typically as will be hereinafter described.

In some applications, the cue stick holder 1 may have initially been deployed in the rolled storage configuration illustrated in FIG. 11. Accordingly, the closure element 51 on the securing member 50 may initially be released or disengaged and the released closure element 51 removed from the rolled cue stick holder 1. The cue stick holder 1 may then be deployed from the rolled storage configuration to the extended functional configuration, as illustrated in FIG. 1, preparatory to use. In some embodiments, the holder panel 2 of the cue stick holder 1 may be elastic and may have sufficient memory to spontaneously recoil to the extended functional configuration upon release and removal of the securing member 50 therefrom. The extended cue stick holder 1 may then be deployed in place on the game table 36, typically as was heretofore described.

As illustrated in FIG. 8, between game plays and/or between games, the cue stick 40 of a player (not illustrated) may be propped or rested against the cue stick holder 1 to prevent the player from having to hold the cue stick 40 as another player executes a shot on the table top 38 or until the beginning of another game. Accordingly, the rear cue stick end 41 of the cue stick 40 may be placed on the floor 46 adjacent to the game table 36. The cue stick 41 may be leaned and propped or rested against the cue stick holder 1 by placing the cue stick 40 in a selected cue stick gap 26 in the holder rack 20 and resting the cue stick 40 against the gap bottom 25 of the cue stick gap 26, as illustrated in FIG. 10, as the cue stick tip 42 of the cue stick 40 terminates above the holder rack 20. The gap side walls 24 of the cue stick gap 26 may maintain the cue stick 40 in the upright propped position by preventing the cue stick 41 from falling to either side. At the player's next turn, the player may retrieve the cue stick 40 for play by grasping and lifting the cue stick 40 from the floor 46 and the cue stick gap 46 of the holder rack 20.

After use, the cue stick holder 1 may be lifted from the game table 36. In some applications, the cue stick holder 1 may be deployed into the rolled storage configuration as illustrated in FIG. 11. The securing member 50 may be deployed and secured via the closure element 51. The rolled cue stick holder 1 may be placed in a carrying bag (not illustrated) or the like for space-efficient stowage and/or transport until the next use.

It will be appreciated by those skilled in the art that the flexible silicon and/or other material composition of the holder panel 2 may impart to the bottom panel surface 3 of the anchor portion 16 a sufficient coefficient of friction that the anchor portion 16 is capable of frictionally engaging the table top 38 of the game table 36 such as to obviate the need to utilize additional weight and/or other attachment devices or mechanisms at the anchor portion 16 for the purpose.

Figure 12:
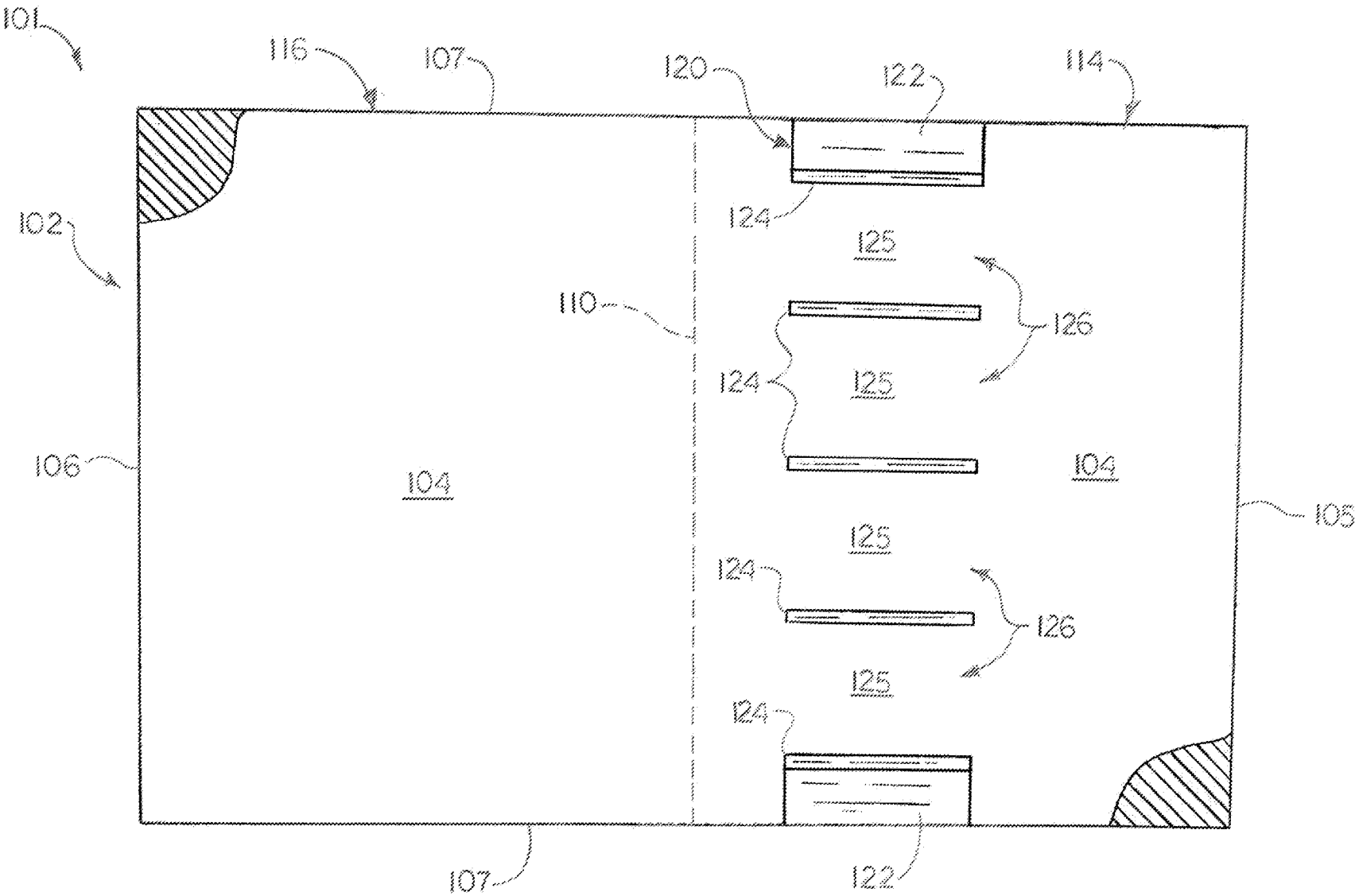
FIG. 12 is a top view of an alternative illustrative embodiment of the cue stick holders.
Figure 13:
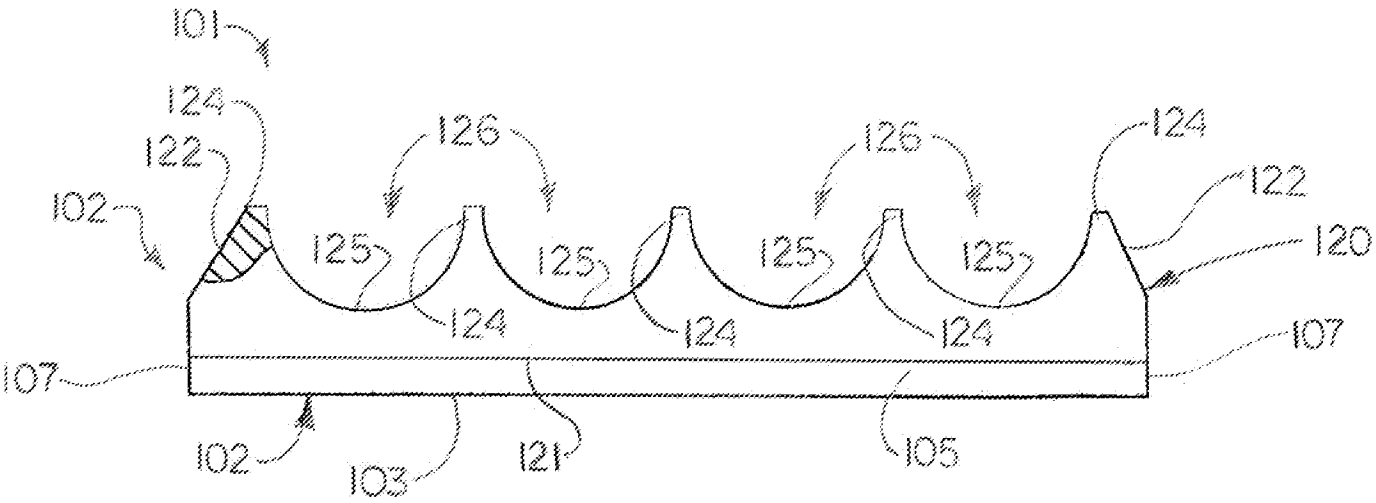
FIG. 13 is a front view of the illustrative cue stick holder illustrated in FIG. 12.

Referring next to FIGS. 12 and 13 of the drawings, an alternative illustrative embodiment of the cue stick holders is generally indicated by reference numeral 101. Unless otherwise indicated, elements of the cue stick holder 101 which are structurally and/or functionally analogous to the respective elements of the cue stick holder 1 that was heretofore described with respect to FIGS. 1-11 are designated by the same respective reference numerals in the 101-199 series in FIGS. 12 and 13. Accordingly, to the extent which is applicable, the same description which was heretofore set forth with respect to the cue stick holder 1 is incorporated by reference herein in its entirety with respect to the cue stick holder 101.

The holder rack 120 of the cue stick holder 101 may include a plurality of gap side walls 124 which may extend from the top panel surface 104 at the rack support portion 114 of the holder panel 102. The spaced-apart gap side walls 124 may traverse the width of the rack support portion 114 between the side panel edges 107 of the holder panel 102. As illustrated in FIG. 13, in some embodiments, the gap bottom surface 125 which extends between each pair of adjacent gap side walls 124 at the bottom of each corresponding cue stick gap 126 may be concave. In some embodiments, the gap bottom surface 125 of each cue stick gap 126 may be flat or planar and may be an extension of the top panel surface 104. In some embodiments, each gap bottom surface 125 may be convex. As illustrated in FIG. 13, the holder rack side portions 122 of the holder rack 120 may angle upwardly and inwardly from the respective side panel edges 107 of the holder panel 102.

Application of the cue stick holder 101 may be as was heretofore described with respect to the cue stick holder 1 in FIGS. 8-11. The cue stick gaps 126 in the holder rack 120 may each be sufficiently sized to accommodate one or more of the cue sticks 40 (FIG. 8) in the propped position of the cue sticks 40.

Figure 14:
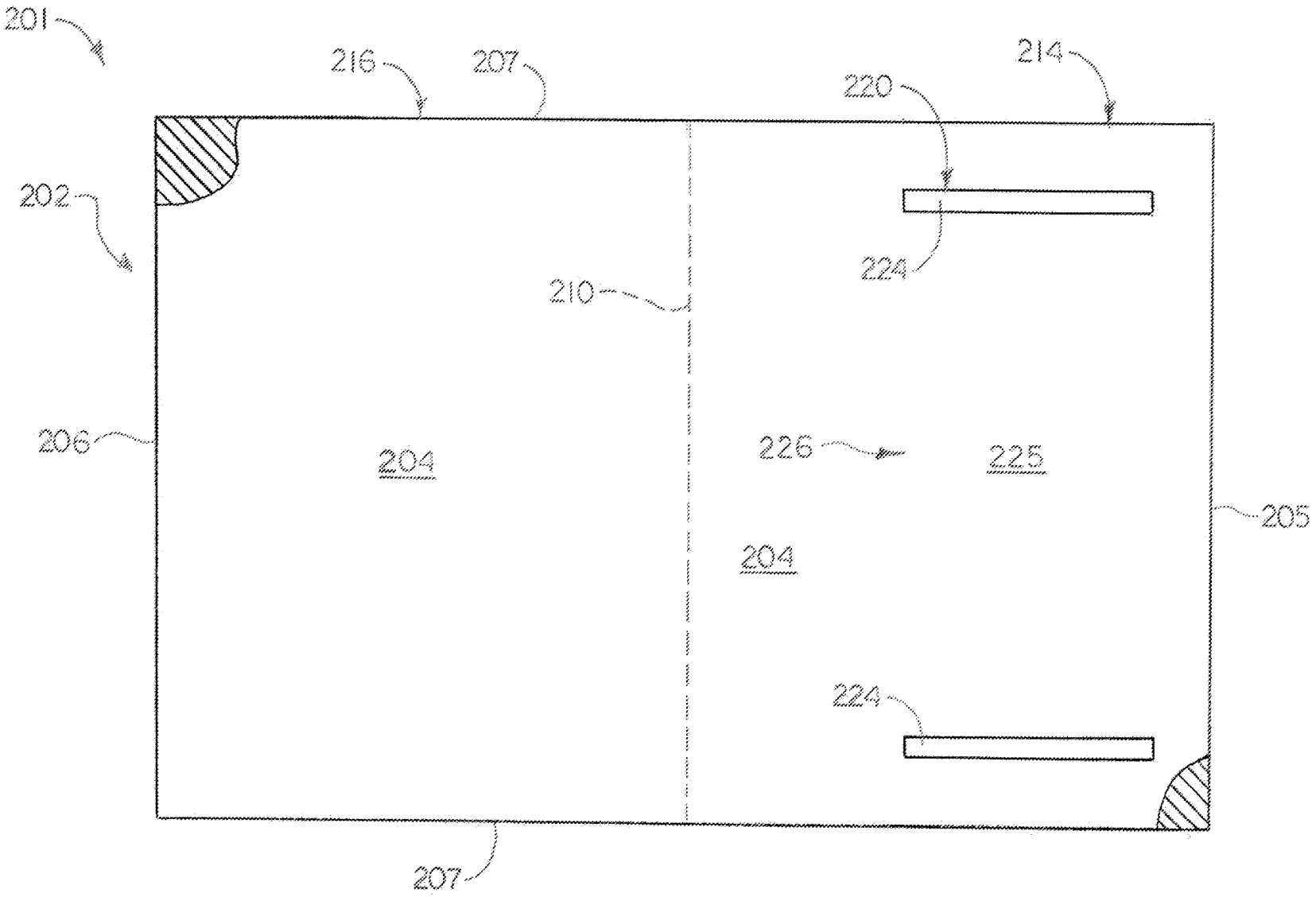
FIG. 14 is a top view of another alternative illustrative embodiment of the cue stick holders.
Figure 15:
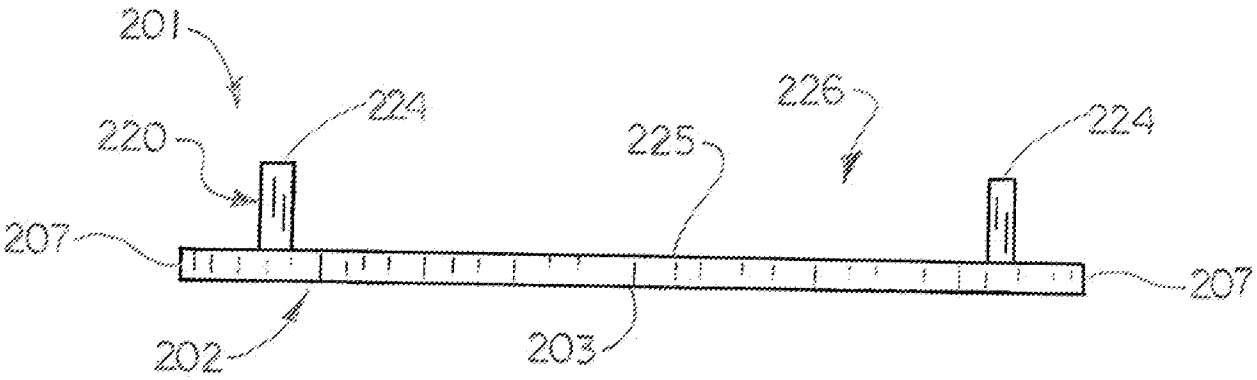
FIG. 15 is a front view of the illustrative cue stick holder illustrated in FIG. 14.

Referring next to FIGS. 14 and 15 of the drawings, another alternative illustrative embodiment of the cue stick holders is generally indicated by reference numeral 201. Unless otherwise indicated, elements of the cue stick holder 201 which are structurally and/or functionally analogous to the respective elements of the cue stick holder 1 that was heretofore described with respect to FIGS. 1-11 are designated by the same respective reference numerals in the 201-299 series in FIGS. 14 and 15. Accordingly, to the extent which is applicable, the same description which was heretofore set forth with respect to the cue stick holder 1 is incorporated by reference herein in its entirety herein with respect to the cue stick holder 201.

The holder rack 220 of the cue stick holder 201 may include a pair of spaced-apart gap side walls 224. The gap side walls 224 may be disposed at or adjacent to the respective side panel edges 207 of the holder panel 202 at the rack support portion 214. A single cue stick gap 226 may be formed by and between the gap side walls 224 and the gap bottom surface 225 of the holder rack 220.

Application of the cue stick holder 101 may be as was heretofore described with respect to the cue stick holder 1 in FIGS. 8-11. The cue stick gap 226 of the holder rack 220 may be sufficiently sized to accommodate one or a plurality of cue sticks 40 (FIG. 8) in the propped position of the cue sticks 40.

Figure 16:
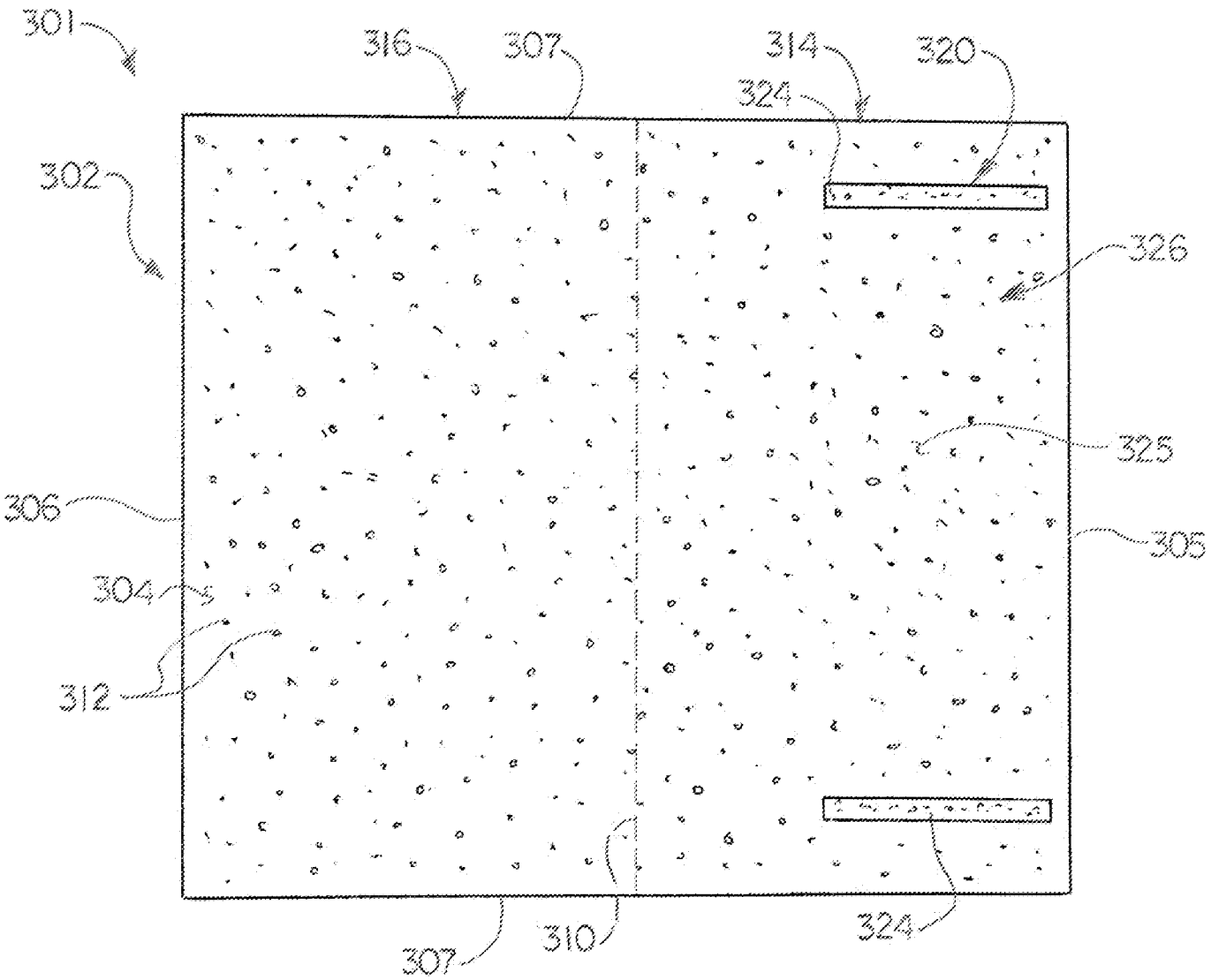
FIG. 16 is a top view of still another alternative illustrative embodiment of the cue stick holders.
Figure 17:
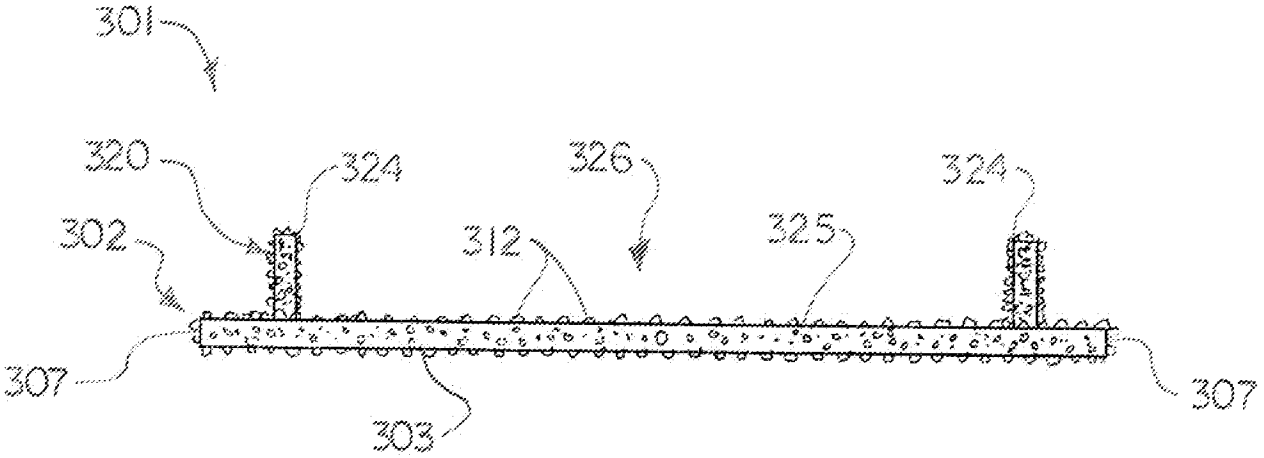
FIG. 17 is a front view of the illustrative cue stick holder illustrated in FIG. 16.

Referring next to FIGS. 16 and 17 of the drawings, still another alternative illustrative embodiment of the cue stick holders is generally indicated by reference numeral 301. Unless otherwise indicated, elements of the cue stick holder 301 which are structurally and/or functionally analogous to the respective elements of the cue stick holder 1 that was heretofore described with respect to FIGS. 1-11 are designated by the same respective reference numerals in the 301-399 series in FIGS. 16 and 17. Accordingly, to the extent which is applicable, the same description which was heretofore set forth with respect to the cue stick holder 1 is incorporated by reference herein in its entirety herein with respect to the cue stick holder 301.

In some embodiments, a plurality of panel protrusions 312 may protrude from the bottom panel surface 303 of the holder panel 302 at the anchor portion 316. Additionally or alternatively, in some embodiments, the panel protrusions 312 may protrude from the top panel surface 304 of the holder panel 302 at the rack support portion 314. Accordingly, the panel protrusions 312 may protrude from the gap bottom surface 325 of the cue stick gap 326. The panel protrusions 312 may protrude from each gap side wall 324 of the holder rack 320.

Application of the cue stick holder 301 may be as was heretofore described with respect to the cue stick holder 1 in FIGS. 8-11. The panel protrusions 312 on the bottom panel surface 303 at the anchor portion 316 may enhance frictional immobilization of the anchor portion 316 on the game table 36. The panel protrusions 312 on the gap bottom surface 325 of the cue stick gap 326 of the holder rack 320 may enhance frictional immobilization of the cue stick or cue sticks 40 on the gap bottom surface 325. Accordingly, the panel protrusions 312 may increase the coefficient of friction of the holder panel 302 to enhance or make stronger the tendency of the holder panel 302 to remain securely in place and immobilized on the game table 36 solely by frictional engagement of the holder panel 302 with the game table 36.

Figure 18:
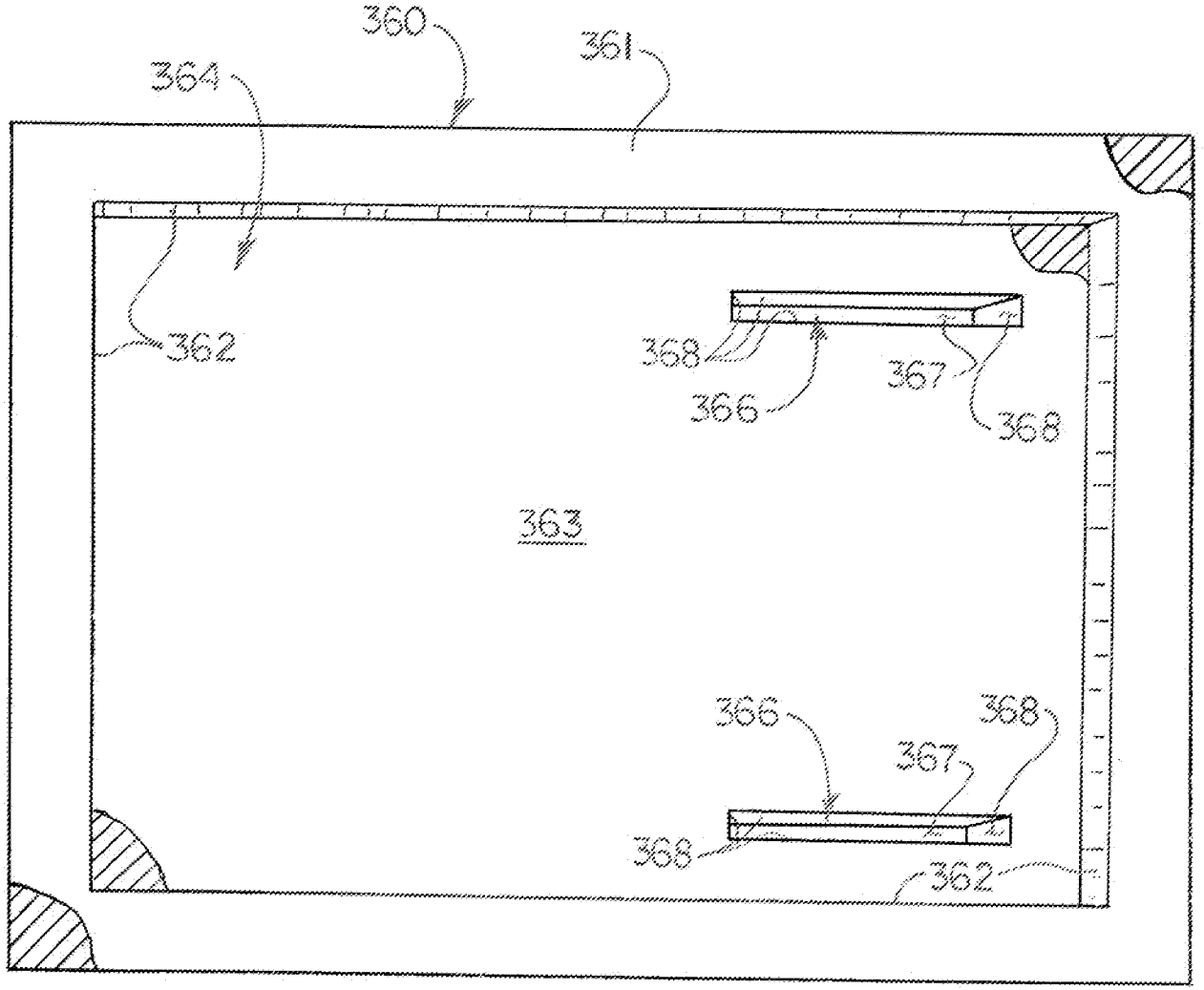
FIG. 18 is a top view of an exemplary holder mold suitable for fabrication of the illustrative cue stick holder illustrated in FIGS. 14 and 15.

Referring next to FIG. 18 of the drawings, an exemplary holder mold which may be suitable for fabrication of the illustrative cue stick holder 201 heretofore described with respect to FIGS. 14 and 15 is generally indicated by reference numeral 360. The holder mold 360 may include a mold rim 361. A rim sidewall 362 may extend from the mold rim 361. A mold bottom 363 may be supported by the rim sidewall 362. A mold interior 364 may be formed by and between the mold sidewall 362 and the mold bottom 363. The mold interior 364 may be suitably sized and configured to facilitate formation of the holder panel 202 (FIGS. 14 and 15) of the cue stick holder 201. Accordingly, the length and width of the mold interior 364 of the holder mold 360 may substantially correspond to the respective length and width of the holder panel 202, whereas the height of the mold sidewall 362 of the holder mold 360 may substantially correspond to the thickness of the holder panel 202.

The holder mold 360 may include a mold cover (not illustrated). The mold cover may be suitably sized and configured to engage the mold rim 361 and completely cover and close the mold interior 364.

At least two mold slots 366 may communicate with the mold interior 364. The mold slots 366 may be disposed in parallel, spaced-apart relationship to each other. Each mold slot 366 may include a mold slot bottom 367 which is recessed with respect to the mold bottom 363. Mold slot sidewalls 368 may extend from the mold bottom 363 to the mold slot bottom 367. Each mold slot 366 may facilitate formation of a corresponding gap sidewall 224 (FIGS. 14 and 15) of the holder rack 220. The length, width, and depth of each mold slot 366 may correspond to the respective length, width, and height of each corresponding gap sidewall 224.

In a typical method of fabrication of the cue stick holder 201 using the holder mold 360, a liquid holder material (not illustrated) may be poured into the mold interior 364 and the mold slots 366 typically until the liquid holder material completely fills the mold interior 364 and the level of the liquid holder material reaches the mold rim 361. The mold cover (not illustrated) may then be placed on the mold rim 361. In some applications, the mold cover may be secured to the mold rim 361 using clamps and/or other suitable attachment techniques known by those skilled in the art. The liquid holder material may include a curable liquid silicon, plastic, rubber, and/or other formulation or composition which is suitable for fabrication of the holder panel 202 and the holder rack 220 of the cue stick holder 201.

The liquid holder material may be allowed to cure, after which the mold cover may be removed from the mold rim 361. The cue stick holder 201, having the cured holder material, may be removed from the mold interior 364 for packaging or use.

The liquid holder material which is used to mold the cue stick holder 201 may include any type of moldable liquid silicone, plastic, and/or rubber material which can be cured to form the cue stick holder 201. For example and without limitation, in some embodiments, the liquid holder material may be ALUMILITE AMAZING MOLD MAKER™ platinum-based silicone mold making rubber, which can be obtained from www.alumilite.com.

In fabrication of the cue stick holder 301, heretofore described with respect to FIGS. 16 and 17, pits or cavities (not illustrated) may be provided in the surfaces of the mold sidewall 362, the mold bottom 363, the mold slot bottom 367 and/or the mold slot sidewalls 368 to form the panel protrusions 312 in the molding process.

Figure 19:
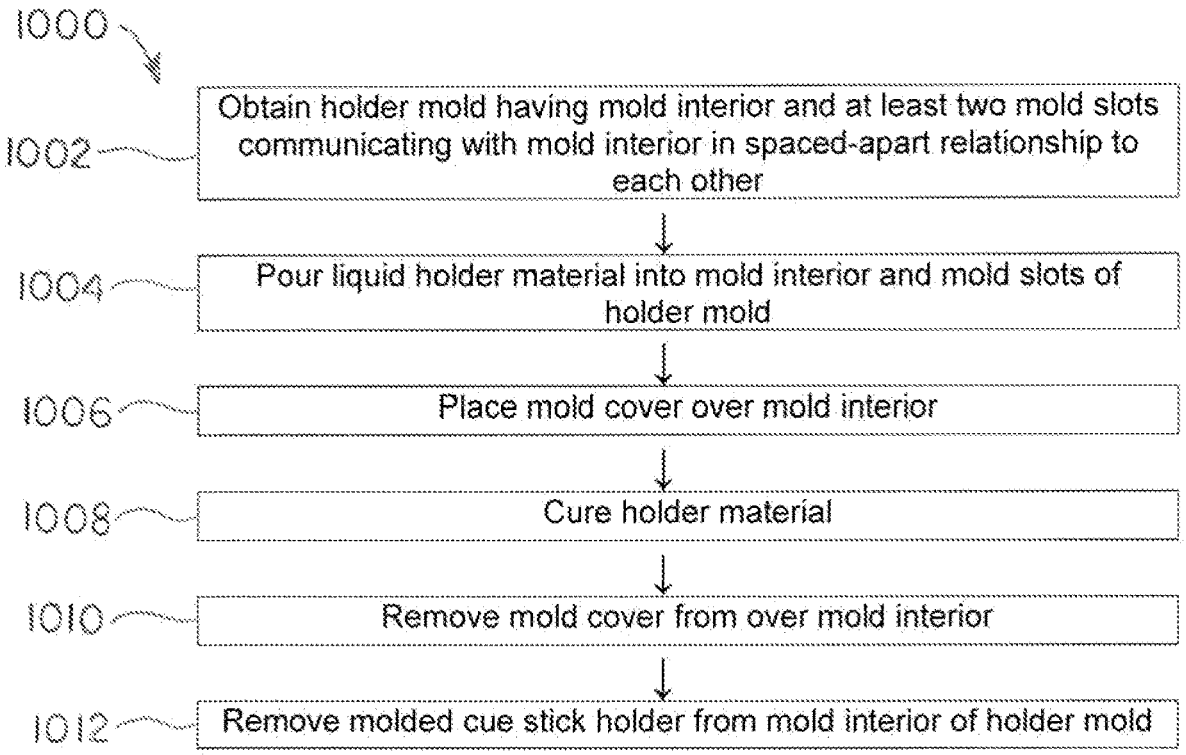
FIG. 19 is a flow diagram of an illustrative embodiment of the cue stick holder fabrication methods of the disclosure.

Referring next to FIG. 19 of the drawings, a flow diagram 1000 of an illustrative embodiment of the cue stick holder fabrication methods of the disclosure is shown. At Step 1002, a holder mold may be obtained. The holder mold may have a mold interior. At least two mold slots may communicate with the mold interior. The mold slots may be disposed in spaced-apart relationship to each other.

At Step 1004, a liquid holder material may be poured into the mold interior and the mold slots of the holder mold.

At Step 1006, a mold cover may be placed over the mold interior.

At Step 1008, the holder material may be cured to form the cue stick holder.

At Step 1010, the mold cover may be removed from over the mold interior.

At Step 1012, the cured and molded cue stick holder may be removed from the mold interior of the holder mold. The cue stick holder may then be packaged for sale or used.

Figure 20:
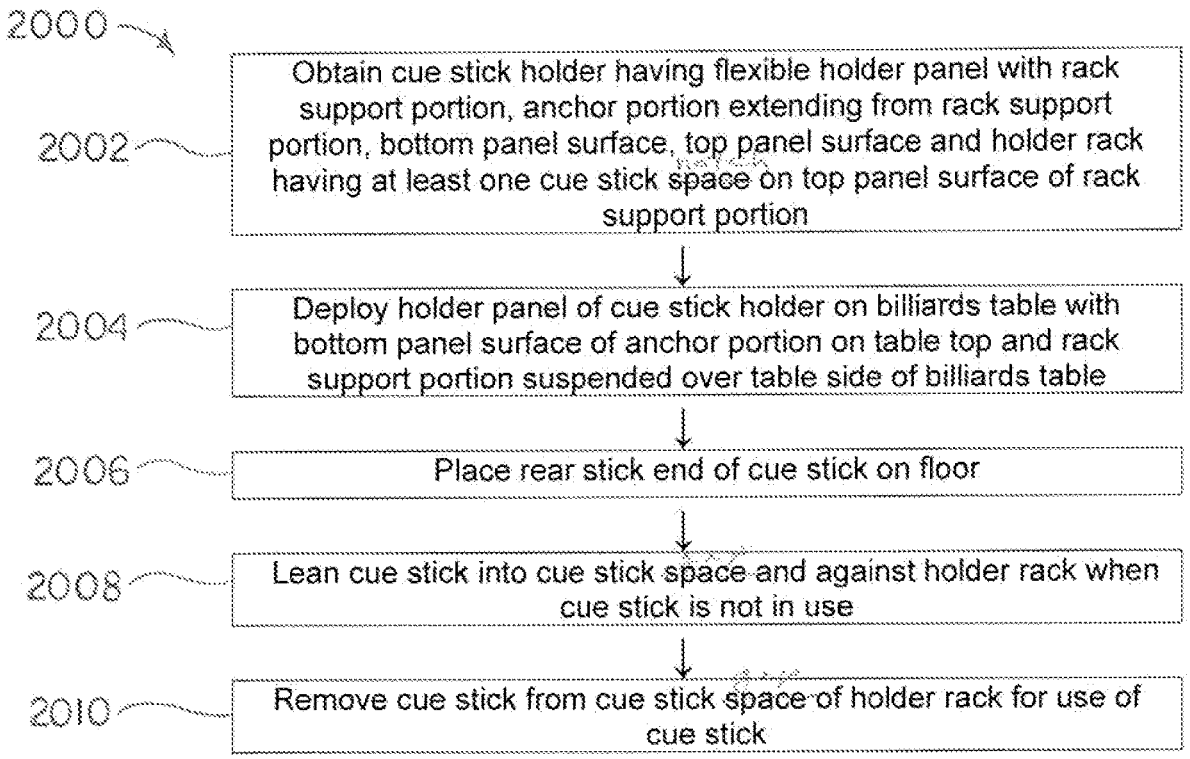
FIG. 20 is a flow diagram of an illustrative embodiment of the cue stick holder methods of use of the disclosure.

Referring next to FIG. 20 of the drawings, a flow diagram 2000 of an illustrative embodiment of the cue stick holder methods of use of the disclosure is shown. At Step 2002, a cue stick holder may be obtained. The cue stick holder may include a flexible holder panel with a rack support portion, an anchor portion extending from the rack support portion, a bottom panel surface, a top panel surface, and a holder rack having at least one cue stick gap on the top panel surface of the rack support portion.

At Step 2004, the holder panel of the cue stick holder may be deployed on a pool, billiards, or like game table with the bottom panel surface of the anchor portion on the table top and the rack support portion suspended over or adjacent to the table side of the game table.

At Step 2006, the rear stick end of at least one cue stick may be placed on the floor adjacent to the game table.

At Step 2008, the cue stick may be leaned into the cue stick gap and against the holder rack when the cue stick is not in use.

At Step 2010, the cue stick may be removed from the cue stick gap of the holder rack and lifted from the floor for use of the cue stick.

While the preferred embodiments of the invention have been described above, it will be recognized and understood that various modifications may be made in the invention and the appended claims are intended to cover all such modifications which may fall within the spirit and scope of the invention.

We claim:

1. A cue stick holder suitable for deployment on a game table to support at least one cue stick resting in a propped position, comprising:

a flexible holder panel configured for frictional immobilization on the game table, the holder panel selectively deployable in an extended functional configuration and rollable in a rolled storage configuration;

a holder rack on the holder panel, the holder rack having at least one cue stick gap sized and configured to receive the at least one cue stick in the propped position thereof; and the holder panel having a coefficient of friction sufficient to render the holder panel securely in place and immobilized on the game table solely by frictional engagement of the holder panel with the game table.

2. The cue stick holder of claim 1 wherein the holder panel comprises a front panel end and a rear panel end, and the holder rack is proximate to the front panel end.

3. The cue stick holder of claim 2 wherein the holder panel comprises a uniform material, thickness, and density from the front panel end to the rear panel end.

4. The cue stick holder of claim 1 further comprising at least one securing member configured to secure the holder panel in the rolled storage configuration.

5. The cue stick holder of claim 1 wherein the holder panel comprises silicone.

6. The cue stick holder of claim 1 wherein the holder rack comprises a holder rack base portion and a pair of holder rack side portions, and the at least one cue stick gap extends into the holder rack base portion between the holder rack side portions.

7. The cue stick holder of claim 1 wherein the holder panel comprises a plurality of panel protrusions.

8. A cue stick holder suitable for deployment on a game table to support at least one cue stick resting in a propped position, comprising:

a flexible holder panel selectively deployable in an extended functional configuration and rollable in a rolled storage configuration, the holder panel comprising:

a bottom panel surface having a coefficient of friction sufficient to render the holder panel securely in place and immobilized on the game table solely by frictional engagement of the holder panel with the game table;

a top panel surface;

a panel midline;

a rack support portion extending forwardly of the panel midline; and an anchor portion extending rearwardly of the panel midline, the bottom panel surface of the holder panel at the anchor portion configured for frictional immobilization on the game table; and a flexible holder rack on the top panel surface of the holder panel at the rack support portion, the holder rack having at least one cue stick gap sized and configured to receive the at least one cue stick in the propped position thereof.

9. The cue stick holder of claim 8 wherein the holder panel comprises a front panel end and a rear panel end, and the panel midline is halfway between the front panel end and the rear panel end.

10. The cue stick holder of claim 9 wherein the holder panel comprises a uniform material, thickness, and density from the front panel end to the rear panel end.

11. The cue stick holder of claim 8 further comprising at least one securing member configured to secure the holder panel in the rolled storage configuration.

12. The cue stick holder of claim 8 wherein the holder panel comprises silicone.

13. The cue stick holder of claim 8 wherein the holder rack comprises a holder rack base portion and a pair of holder rack side portions, and the at least one cue stick gap extends into the holder rack base portion between the holder rack side portions.

14. The cue stick holder of claim 8 wherein the bottom panel surface and the top panel surface of the holder panel each comprises a plurality of panel protrusions.

15. A cue stick holder suitable for deployment on a game table having table sides, a table top and a table edge to support at least one cue stick resting in a propped position, the cue stick holder comprising:

a flexible holder panel comprising:

a bottom panel surface;

a top panel surface;

a front panel end;

a rear panel end;

a panel midline halfway between the front panel end and the rear panel end;

a rack support portion extending forwardly of the panel midline; and an anchor portion extending rearwardly of the panel midline, the bottom panel surface of the holder panel at the anchor portion configured for frictional immobilization on the table top of the game table and having a coefficient of friction sufficient to render the holder panel securely in place and immobilized on the game table solely by frictional engagement of the holder panel with the game table;

a flexible holder rack on the top panel surface of the holder panel at the rack support portion, the holder rack and the holder panel formed in one piece of the same material and having a unitary construction, the holder rack comprising:

at least two rack side walls extending from the top panel surface of the holder panel in spaced-apart relationship to each other; and at least one cue stick gap between the at least two rack side walls, respectively, the at least one cue stick gap sized and configured to receive the at least one cue stick in the propped position thereof, and wherein the holder panel and the holder rack are selectively deployable in an extended configuration and a rolled storage configuration.

16. The cue stick holder of claim 15 wherein the holder panel comprises a uniform material, thickness, and density from the front panel end to the rear panel end.

17. The cue stick holder of claim 15 wherein the holder panel and the holder rack comprise silicone.

18. The cue stick holder of claim 15 further comprising at least one securing member configured to secure the holder panel and the holder rack in the rolled storage configuration.

* * * * *